US005346180A

United States Patent [19]

Popowich

[11] Patent Number: 5,346,180

[45] Date of Patent: Sep. 13, 1994

[54] PANTOGRAPH JACK

[75] Inventor: David J. Popowich, Toronto, Canada

[73] Assignee: Seeburn Metal Products Limited, Ontario, Canada

[21] Appl. No.: 74,445

[22] Filed: Jun. 10, 1993

[51] Int. Cl.[5] ..... B66F 3/22

[52] U.S. Cl. ..... 254/126

[58] Field of Search ..... 254/122, 126, 124, DIG. 4

[56] References Cited

U.S. PATENT DOCUMENTS

| | | | |
|---|---|---|---|
| 4,695,036 | 9/1987 | Yukimoto et al. | 254/126 |
| 5,131,628 | 7/1992 | Huang . | |
| 5,176,362 | 1/1993 | Seksaria . | |
| 5,184,806 | 2/1993 | Erschens . | |

FOREIGN PATENT DOCUMENTS

| | | | |
|---|---|---|---|
| 35115 | 6/1929 | France | 254/126 |
| 2204559 | 11/1988 | United Kingdom . | |
| 2228249 | 8/1990 | United Kingdom . | |
| 2238774 | 6/1991 | United Kingdom . | |

*Primary Examiner*—Robert C. Watson

*Attorney, Agent, or Firm*—Cushman, Darby & Cushman

[57] ABSTRACT

A pantograph jack is disclosed having a drive screw having a length required to span a distance between a threaded annulus at a first joint and a second joint, the improvement comprising an extension means to extend the threaded annulus towards the second joint to shorten the said distance and the length required of the drive screw.

4 Claims, 8 Drawing Sheets

PANTOGRAPH JACK

BACKGROUND AND SUMMARY OF THE INVENTION

This invention relates to a lifting jack for automobiles and other vehicles. More particularly, it relates to an improvement in the construction of a pantograph jack to reduce the length of the drive screw and the space required for storage.

A portable jack is often stored in a vehicle to enable a driver to lift the vehicle to effect emergency repairs, for example, to change a tire. One popular type of jack for automobiles is the pantograph jack. Known pantograph jacks typically have four arms hinged in a parallelogram at four joints. One joint is located on a base of the jack. Another joint is positioned at a load rest vertically above the base. Two other free floating joints are located on a horizontal diagonal at opposite comers of the parallelogram formed by the arms. When the free floating joints are drawn together in a horizontal plane the arms extend vertically to lift the load support with respect to the base and vice versa. The relative position of the free floating joints is controlled by a drive screw or threaded shaft which links them together.

Modem automobile design places increasing emphasis on efficient use of space. In turn, jack manufacturers have focused attention on reducing the amount of trunk space required for jack storage. It is has been found that it is often more space efficient to store a pantograph jack in a diamond or square shape rather than in either of the fully extended or lowered positions. A problem is encountered in this configuration, however. The drive screw must be long enough to span between the free floating joints in the fully lowered position. Therefore, in the partially lowered diamond shape, the drive screw extends outside the parallelogram of the arms. Extra storage space is then required to accommodate the projecting portion of the screw.

The present invention is directed to an improvement in the construction of a pantograph jack to reduce or eliminate the projection of the drive screw in the partially lowered jack position.

The invention is an extension mechanism attached to one of the free floating joints, hereafter the first joint, which projects a threaded annulus along the diagonal towards the second free floating joint thereby reducing the length required of the drive screw.

More particularly, the improvement of this invention relates to a pantograph jack having a base to position the jack on a ground support, a load rest to fit under and to carry a vehicle, a parallelogram pantograph and a drive screw. The pantograph has first and second arms hinged at the base, third and fourth arms hinged at the load rest, first and third arms hinged at a first joint and second and fourth arms hinged at a second joint, with the first and second joints on an approximately horizontal diagonal of the pantograph. The drive screw is mounted between the first and second joints to rotate about an axis coextensive with the diagonal. The length of the drive screw is sufficient to connect between the first and second joints when the jack is in a fully lowered position. The jack has a trunnion nut moans pivotally mounted in the first joint which has a threaded annulus to engage the drive screw. Rotation of the drive screw within the threaded annulus drives the first joint linearly along the drive screw. There is also a trunnion bearing means pivotally mounted in the second joint having an opening to receive an unthreaded portion of the drive screw in a rotatable but linearly fixed connection relative to the drive screw.

The improvement of this invention comprises a trunnion nut means having an extension means to extend the threaded annulus along the diagonal towards the second joint and a drive screw having a length sufficient to span from the trunnion bearing means of the second joint into the threaded annulus of the trunnion nut means of the first joint when the jack is in the fully lowered position.

BRIEF DESCRIPTION OF THE DRAWINGS

In the figures ,which illustrate preferred embodiments of the present invention.

DETAILED DESCRIPTION OF THE DRAWINGS

Figure 1:
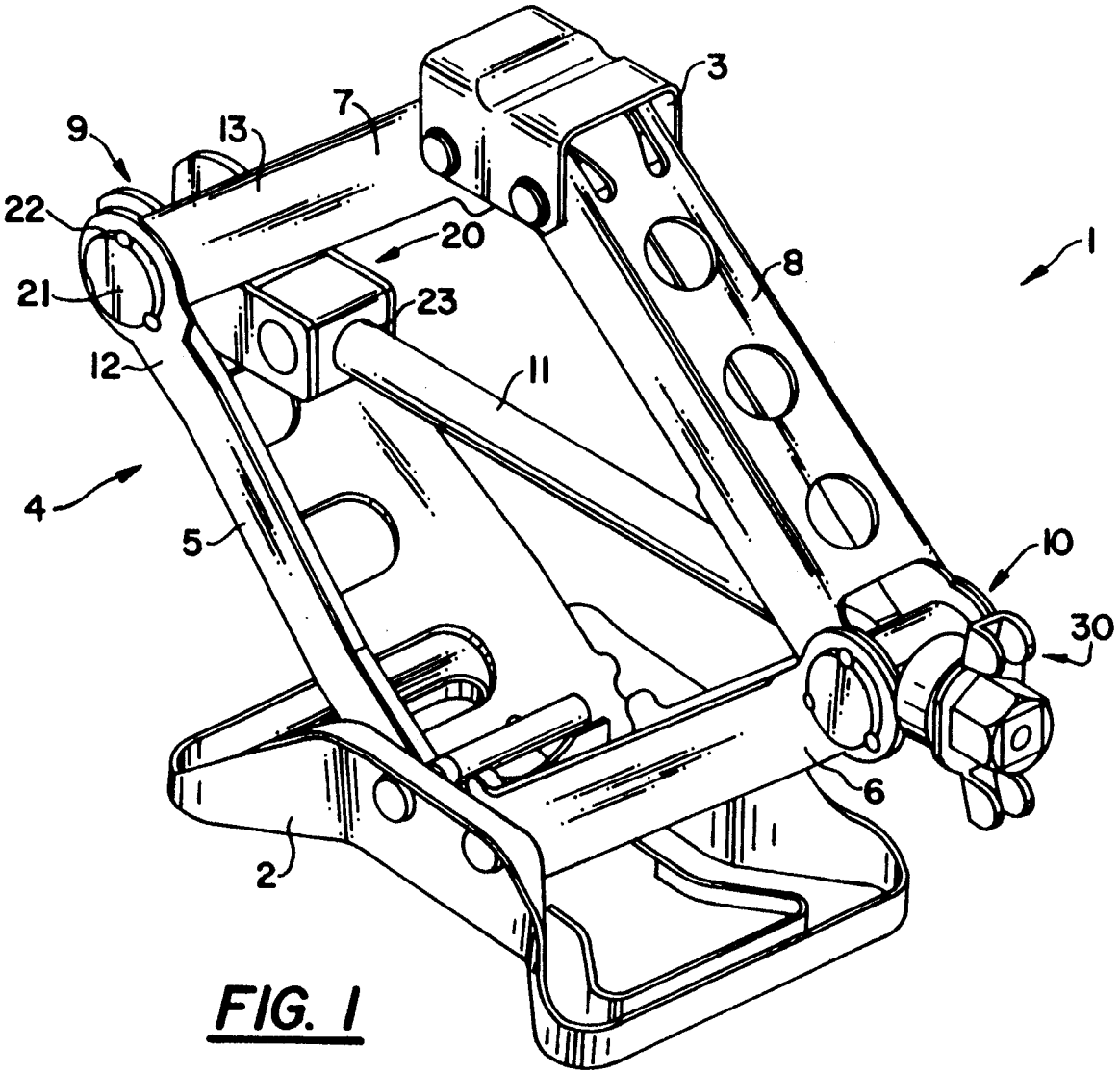
FIG. 1 is an isometric view of a pantograph jack of this invention.

In the figures which illustrate the preferred embodiments of this invention, like numerals indicate like elements, FIG. 1 illustrates a pantograph jack (1) of this invention. The jack (1) has a base (2) to position the jack (1) on a ground support. A load rest (3) is provided to fit under, to connect with and to carry a vehicle (not shown) during lifting. The jack (1) has a parallelogram shaped pantograph (4) made up of a first arm (5) and a second arm (6) hinged at the base (2), a third arm (7) and a fourth arm (8) hinged at the load rest (3). The first arm (5) and the third arm (7) hinge together at a first joint (9) and the second arm (6) and the fourth arm (8) hinge together at a second joint (10). The first and second joints (9 and 10) lie on an approximately horizontal diagonal of the pantograph (4). A ddve screw (11) is mounted between said first and second joints (9 and 10) to rotate about an axis coextensive with said diagonal. The drive screw (11) has a length sufficient to connect the first and second joints (9 and 10) when the jack (1) is in a fully lowered position, i.e., when the load rest (3) is lowered to close proximity to the base (2). The improvement of the jack (1) lies primarily in the construction of the trunnion nut means (20).

A trunnion nut means (20) is mounted in the first joint (9) by means of a trunnion pin (21) in holes (22) cut in side flanges (12 and 13) of channel sections forming first and third arms (5 and 7). The trunnion pin (21) permits the trunnion nut means (20) to pivot and thus maintain a horizontal position in any lifting position of the arms (5 and 7). The trunnion nut means has a threaded annulus (23) to engage the drive screw (11). As the ddve screw (11) rotates in the threaded annulus (23) the first joint (9) is moved linearly along the ddve screw (11) either to or from the second joint (10).

Figure 10:
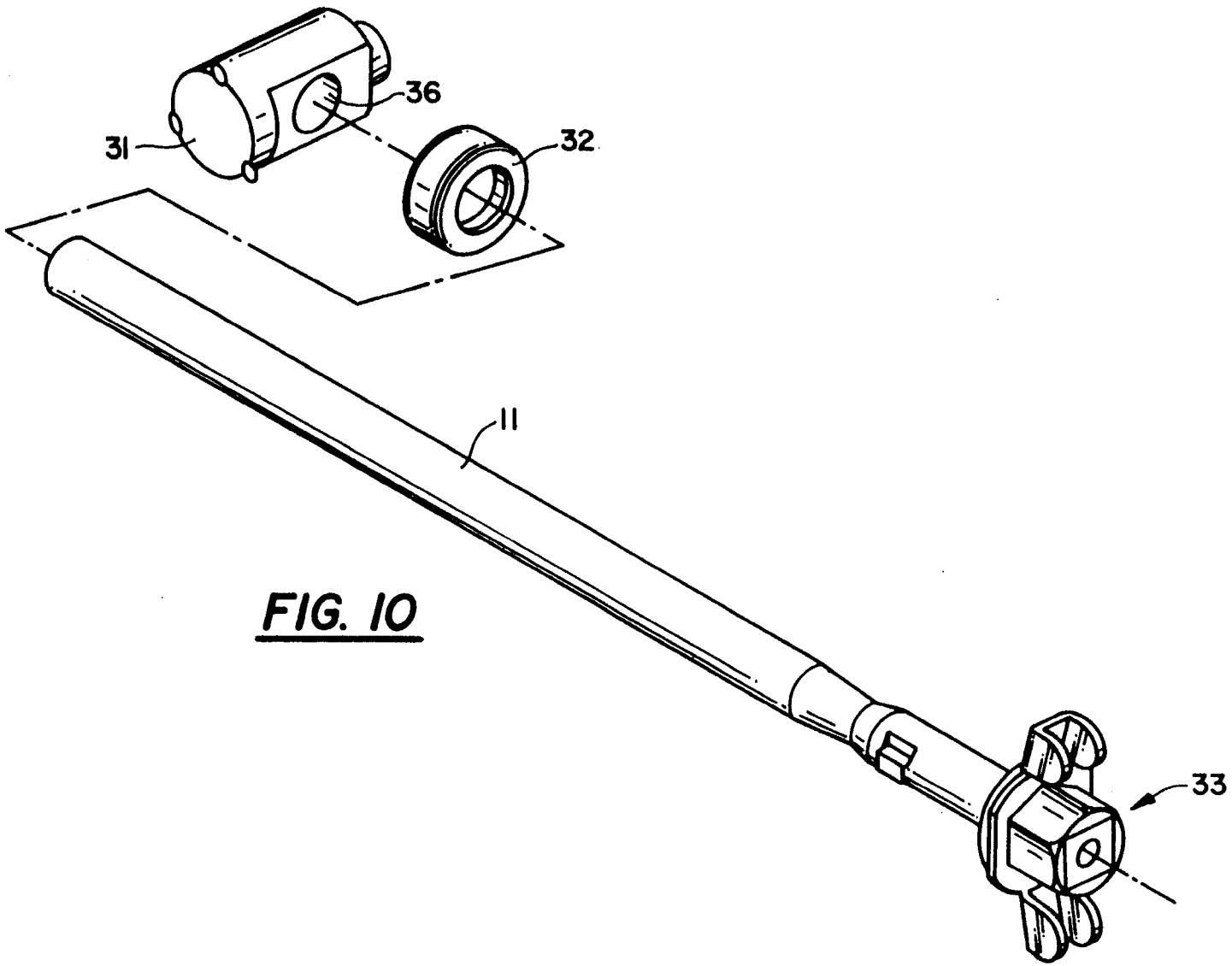
FIG. 10 shows the combination of the trunnion bearing means and the drive screw of this invention.
Figure 11:
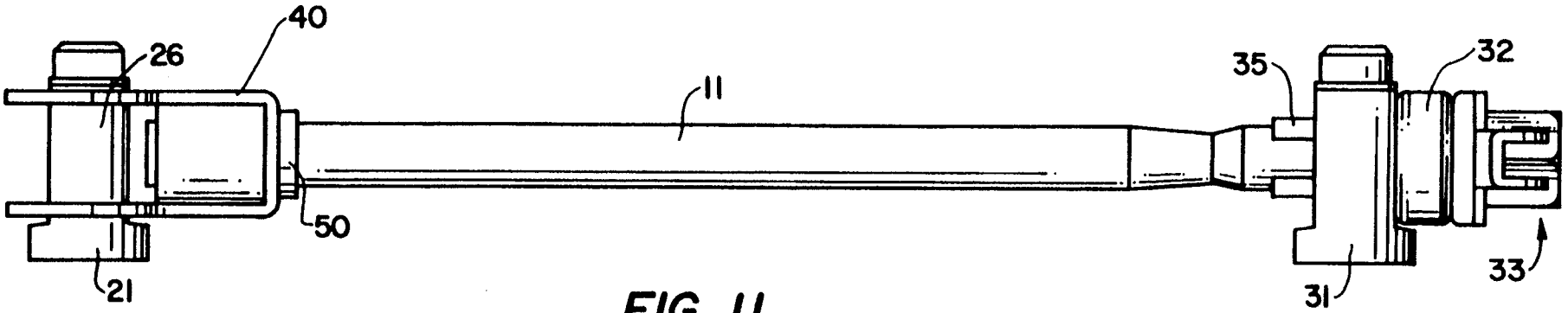
FIG. 11 is a top view of the connection of the ddve screw with the U-bracket embodiment of the trunnion nut and with the trunnion bearing of this invention.

The second joint (10) of the jack (1) has a trunnion bearing means (30) similarly pivotally mounted relative to the arms (6) and (8). The trunnion bearing means (30) has an opening (not shown in FIG. 1) to receive an unthreaded portion of the drive screw (11) in a rotatable connection but the drive screw is linearly fixed relative to the second joint (10). As illustrated in FIGS. 10 and 11, the trunnion bearing means may comprise a trunnion pin (31), a bearing (32) and a cap (33). The drive screw (11) fits through the bearing (32) and through a clearance hole (36) in the trunnion pin (31) where it is secured by stakes (35). The trunnion pin (31) pivotally connects into the second joint (10).

The improvement of this invention is directed to the trunnion nut means (20), The improvement is the provision of an extension means to extend the threaded annulus (23) along the diagonal towards the second joint (10). A shorter drive screw (11) will now extend from the trunnion bearing means (30) to the threaded annulus (23) when the jack (1) is fully lowered. The shorter ddve screw (11), however, does not project beyond the first joint (9) in a partially lowered position such as shown in FIG. 1. The length of the extension may be predetermined empirically to eliminate or reduce projection of the drive screw (11) for a particular storage position, Existing jacks may be modified or new jacks manufactured to take advantage of this improvement.

Figure 2:
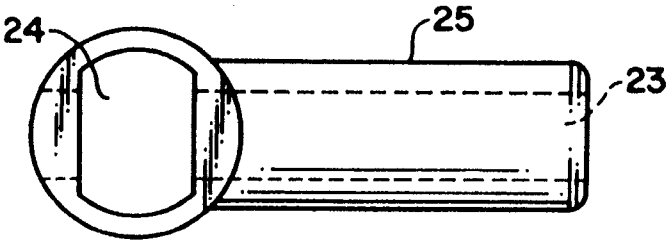
FIG. 2 is an improved integral trunnion nut of a preferred embodiment of this invention.
Figure 3:
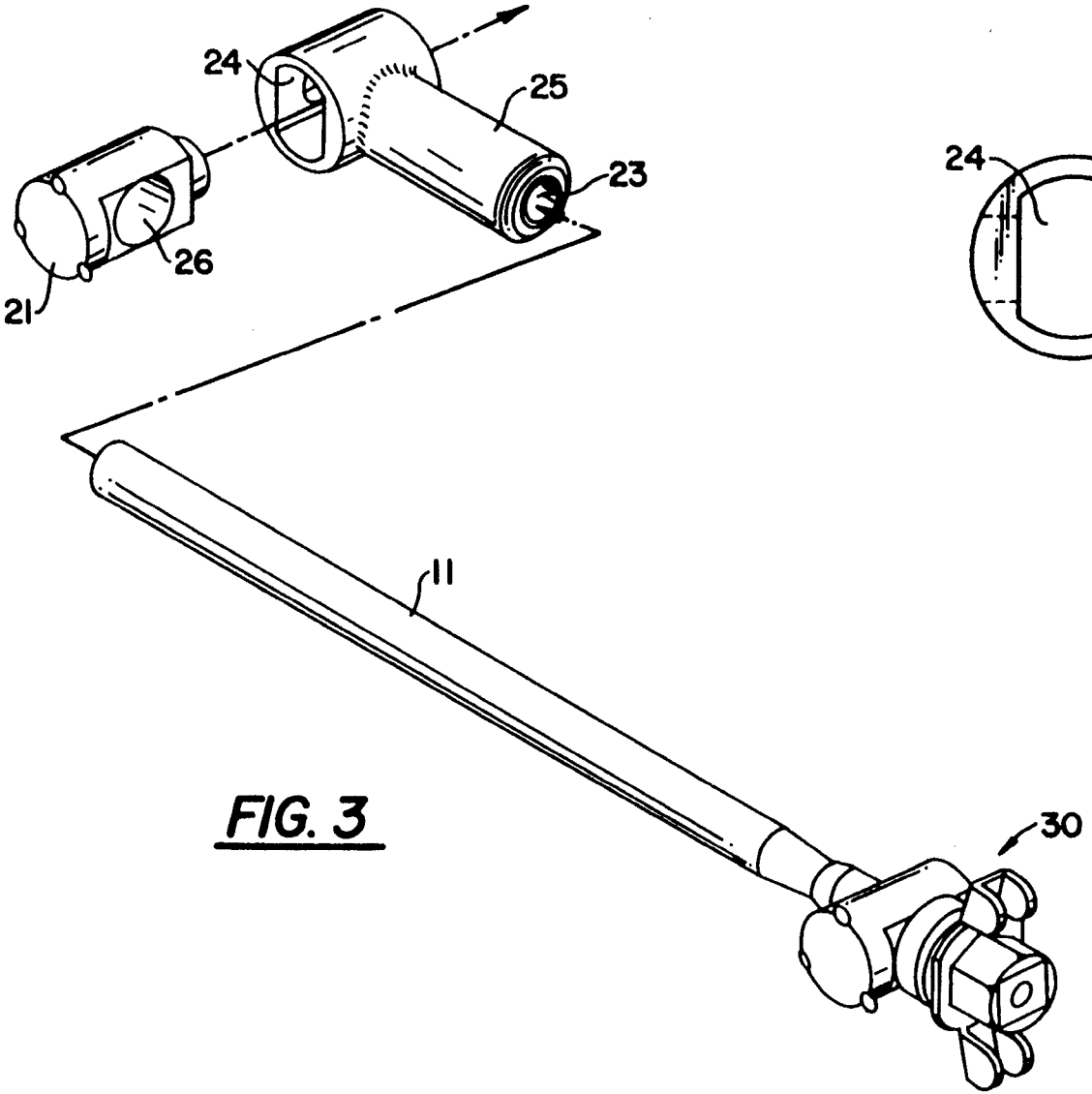
FIG. 3 is an exploded view of the drive screw connection with the integral trunnion nut.
Figure 4:
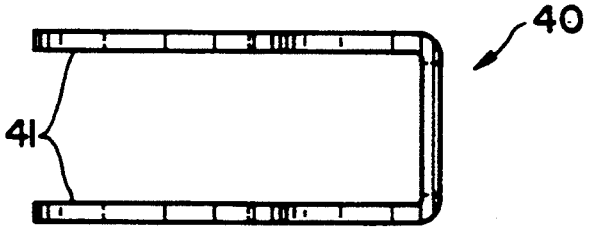
FIG. 4 is a top view of an extension U-bracket of a preferred embodiment of this invention.
Figure 5:
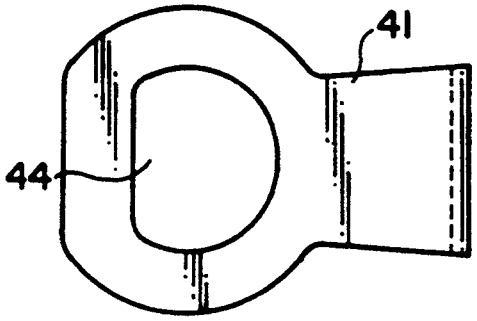
FIG. 5 is a side view of the U-bracket.
Figure 6:
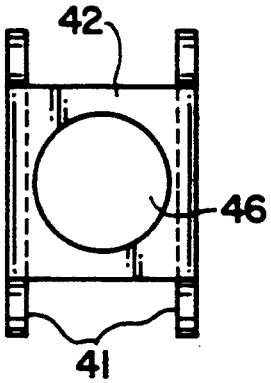
FIG. 6 is an end view of the U-bracket showing a tapped hole for the drive screw.

One preferred embodiment of this invention is shown in FIGS. 2 and 3, The improved trunnion nut means (20) comprises a trunnion pin (21 in FIGS. 1 and 3), a trunnion pin keyhole (24), an extension tube (25) and a threaded annulus (23). The trunnion pin (21) is mounted into holes (22) in the flanges (12 and 13) of arms (5 and 7) at first joint (9) as previously described in relation to FIG. 1. As best illustrated in FIG. 3, the trunnion pin (21) passes through the trunnion pin keyhole (24). The extension tube (25) integrally extends from the keyhole (24) for a predetermined distance towards the second joint (10). The threaded annulus (23) is tapped through the extension tube (25) to receive the drive screw (11). The trunnion pin (21) has a clearance hole (26) to permit the ddve screw (11) to pass through as the jack is lifted.

Figure 7:
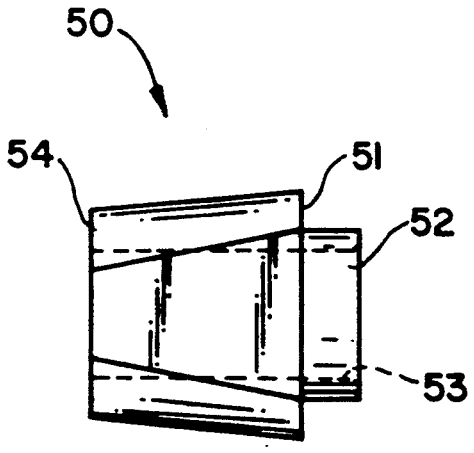
FIG. 7 is a side view of the T-nut of this invention.
Figure 8:
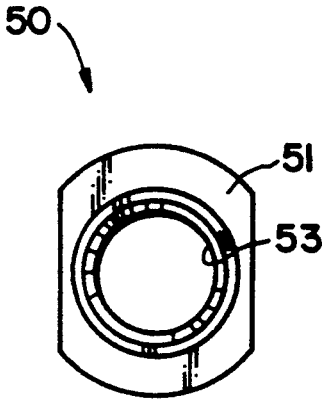
FIG. 8 is an end view of the T-nut of this invention.
Figure 9:
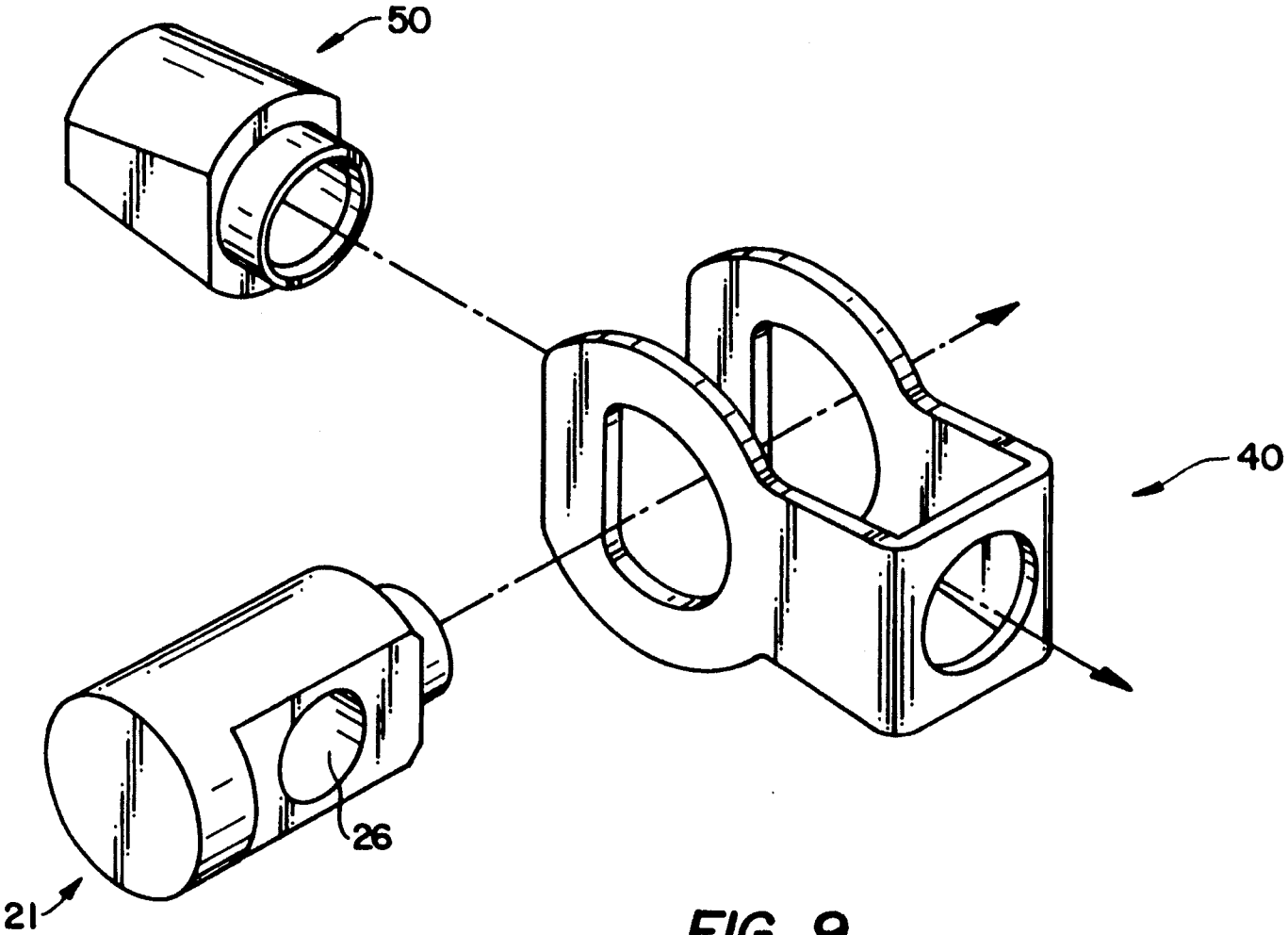
FIG. 9 shows the combination of the T-nut, U-bracket and trunnion of this invention.

Another preferred embodiment is shown in FIGS. 4–9 and 11. In this embodiment, the trunnion nut means comprises a trunnion pin (21 in FIG. 9), a U-bracket (40), and a T-nut (50). The trunnion pin (21) fits into the joint (9) and through a pair of keyholes (44) cut in side flanges (41) of the U-bracket (40). The side flanges (41) extend a predetermined distance to a crosspiece (42) to provide the required extension. The crosspiece (42) is cut with a T-nut hole (46) to receive the T-nut (50). The T-nut (50) is shown in FIGS. 7 and 8. It has a shoulder (51) to rest against the crosspiece (42) and an insert (52) to fit into the T-nut hole (46). A threaded annulus (53) is provided through the T-nut to receive the drive screw (11). A butt end (54) is provided to abut with the trunnion pin (21) to keep the T-nut insert (52) in the T-nut hole (46). The keyhole (44) maintains the alignment of the threaded annulus (53) and the clearance hole (26) in the trunnion pin (21) to permit passage of the drive screw (11). See the assembly in FIGS. 9 and 11.

Figure 12:
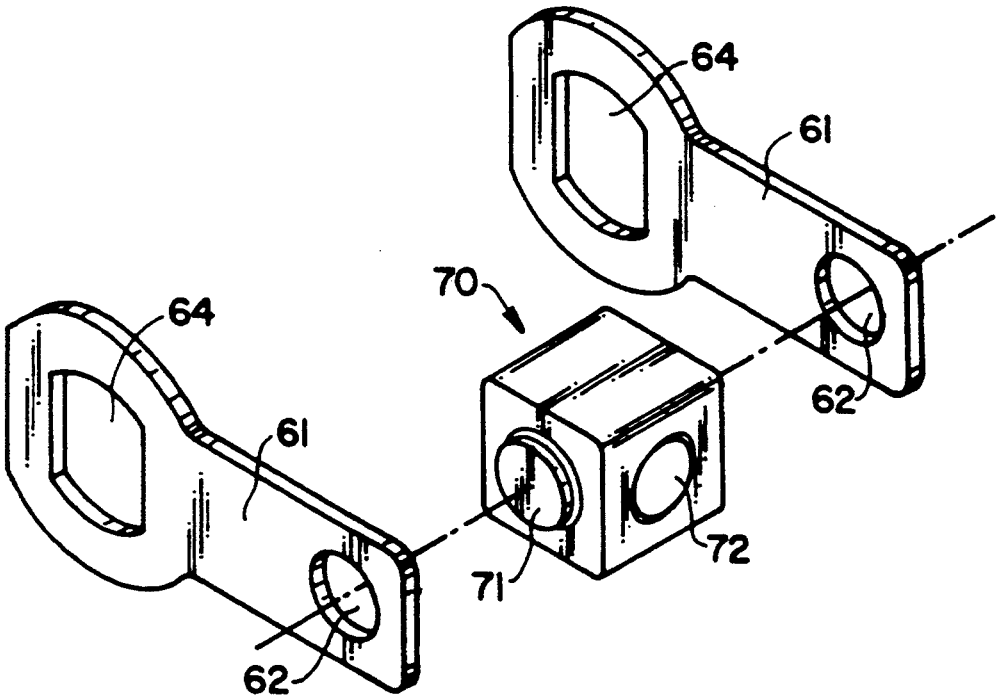
FIG. 12 is an exploded view of a pair of extension brackets and a threaded annulus of a preferred embodiment of this invention.
Figure 13:
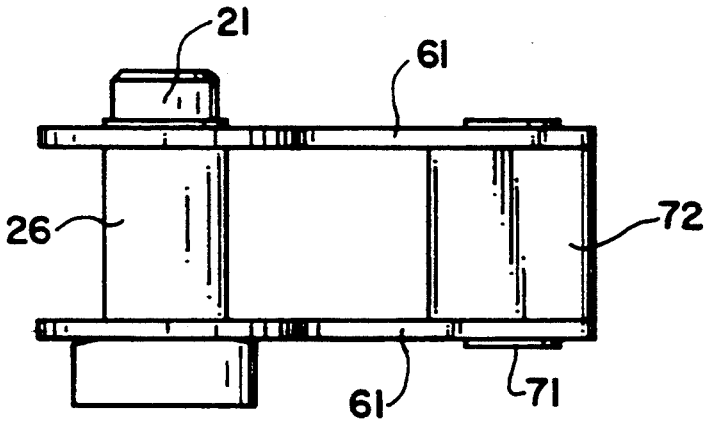
FIG. 13 is a top view of a pair of extension brackets and a threaded annulus of this invention.

In another embodiment, shown in FIGS. 12 and 13, the trunnion nut means comprises a trunnion pin (21) pivotally mounted in the first joint (9) and first and second extension brackets (61) and a gudgeon nut (70). Each extension bracket (61) has a keyhole (64) to receive the trunnion pin (21) and extends therefrom for a predetermined distance to provide the required extension. A gudgeon hole (62) is cut in the extended portion of the bracket (61) to receive the gudgeon nut (70). The gudgeon nut (70) has a threaded annulus (72) to receive the drive screw therein and gudgeon pins (71) to fit into the gudgeon holes (62) of the first and second extension brackets (61). As shown in FIG. 13, the threaded annulus (72) aligns with the clearance hole (26) of the trunnion pin (21) to permit the passage of the ddve screw (11).

I claim:

1. A pantograph jack comprising:

a base for engaging a ground support;

a load rest for placement under and to engage a vehicle;

a parallelogram pantograph including first and second arms each pivotally coupled at a first end thereof to said base, third and fourth arms each pivotally coupled at a first end thereof to the load rest, second ends of said first and third arms being pivotally coupled at a first joint and second ends of said second and fourth arms being pivotally coupled at a second joint, said first and second joints being disposed in a substantially in a common horizontal plane on a substantially horizontal diagonal of the pantograph, a drive screw having first and second longitudinal end portions and mounted so as to extend between said first and second joints and so as to be rotatable about an axis coextensive with said diagonal, said drive screw having a length so as to extend between the first and second joints irrespective of a vertical distance between said base end and said load rest;

said second joint including a trunnion bearing having an opening coaxial with said drive screw for receiving said second longitudinal end portion of the drive screw so that said drive screw is rotatable relative to said trunnion bearing but is linearly fixed with respect thereto;

said first joint including a trunnion nut assembly, said trunnion nut assembly comprising a trunnion pin engaged with said second ends of said first and third arms so that said first and third arms are pivotable about said trunnion pin, said trunnion pin having a long axis, first and second substantially flat side faces parallel to said long axis and a drive screw receiving bore extending in a direction substantially perpendicular to said long axis; and a unitary extension component having first and second portions, said first portion having a trunnion pin key hole extending in a first direction and having an internal transverse cross-section corresponding to a transverse cross-section of said trunnion pin for slideably receiving said trunnion pin, said second portion extending in a second direction, said second direction being generally perpendicular to said first direction, and projecting towards said second joint to shorten a distance between said first and said second joints and thereby minimizing a length of said drive screw, said second portion having a threaded bore defined therethrough for rotatably receiving said drive screw, and said first portion having an aperture defined through a wall thereof aligned with said threaded bore of said second portion of said trunnion nut assembly, said drive screw receiving bore of said trunnion pin being aligned with said threaded bore and said aperture when said trunnion pin is received in said key hole.

2. A pantograph jack as in claim 1, wherein said drive screw receiving hole of said trunnion pin extends between said flat faces thereof.

3. A pantograph jack as in claim 1, wherein flat faces are parallel to one another.

4. A pantograph jack as in claim 1, wherein said second portion of said trunnion nut assembly is substantially cylindrical.

* * * * *

UNITED STATES PATENT AND TRADEMARK OFFICE

CERTIFICATE OF CORRECTION

PATENT NO. : 5,346,180

DATED : September 13, 1994

INVENTOR(S) : POPOWICH

It is certified that error appears in the above-indentified patent and that said Letters Patent is hereby corrected as shown below:

In Column 1, line 26, "Modem" should be --Modern--.

In Column 2, line 34, "ddve" should be --drive--;

line 60, "ddve" should be --drive--.

In Column 3, line 8, "ddve" should be --drive--;

line 10, "ddve" should be --drive--;

line 53, "ddve" should be --drive--.

In Column 4, line 20, "ddve" should be --drive--.

Signed and Sealed this

Twenty-eight Day of March, 1995

*Attest:*

Bruce Lehman

BRUCE LEHMAN

*Attesting Officer*

*Commissioner of Patents and Trademarks*